US005850590A

United States Patent [19]

Furuta et al.

[11] Patent Number: 5,850,590

[45] Date of Patent: Dec. 15, 1998

[54] METHOD FOR MAKING A POROUS SINTERED MATERIAL

[75] Inventors: Seiya Furuta; Kenichi Aota; Kohro Takatsuka; Shigeki Saka; Masahiro Chiji; Masaru Saito, all of Kobe, Japan

[73] Assignee: Kabushiki Kaisha Kobe Seiko Sho, Kobe, Japan

[21] Appl. No.: 634,920

[22] Filed: Apr. 19, 1996

[51] Int. Cl.[6] ..... B22F 1/04

[52] U.S. Cl. ..... 419/49; 419/2

[58] Field of Search ..... 419/49, 54, 2

[56] References Cited

U.S. PATENT DOCUMENTS

| | | | |
|---|---|---|---|
| 5,126,103 | 6/1992 | Ishizaki et al. | 419/2 |
| 5,152,828 | 10/1992 | Katoh | 75/229 |
| 5,625,861 | 4/1997 | Nishi et al. | 419/2 |
| 5,678,162 | 10/1997 | Barlow et al. | 419/2 |

*Primary Examiner*—Ngoclan Mai

*Attorney, Agent, or Firm*—Oblon, Spivak, McClelland, Maier & Neustadt, P.C.

[57] ABSTRACT

The invention provides a method for making a novel porous sintered material according to an HIP (Hot Isostatic Press) molding technique usually used for the purpose of obtaining defect-free and highly dense powder products. In the method of the invention, a capsule containing a starting powder in a hermetically sealed condition is heated according to a predetermined temperature pattern and is also subjected to hot isostatic pressing while a pressure is arrived at a maximum pressure level substantially in coincidence with commencement of a sintering temperature-applying period in the temperature pattern and is gradually lowered from the maximum pressure level during the sintering temperature-applying period. By the method, excessive densification is suppressed and the resulting sintered material has a required porosity and is provided with pores open to outside in the inside thereof, along with good strength and surface processability.

19 Claims, 7 Drawing Sheets

$$\rho = \frac{x^2}{2\alpha}$$

$$\rho = \frac{x^2}{4\alpha}$$

METHOD FOR MAKING A POROUS SINTERED MATERIAL

BACKGROUND OF THE INVENTION

This invention relates to a method for making a porous sintered material which has good gas and moisture permeabilities. More particularly, the invention relates to a method for making a porous sintered material which is adapted for use as molds for injection molding, vacuum molding, blow molding and in-mold decorating and also as a material for machine parts such as gas bearings.

A method for making a porous sintered material for constituting molds for plastic moldings is set out, for example, in Japanese Laid-open Patent Application No. 2-101102. In the method, short fibers of iron-based metals, carbon powder, and, optionally, reinforcing metallic powders are mixed and the resultant mixture is subjected to cold isostatic pressing, followed by heating and sintering in vacuum or in a reductive atmosphere.

Like the sintered materials obtained by sintering a green compact of metallic powder, the sintered material made by this method is a porous sintered material which has open cells communicating to the outside in the inside thereof. In addition, the sintered material exhibits strength greater than a porous sintered material of metallic powder owing to the sintering through the metallic short fibers and also to the carburization action of the carbon powder contained therein.

In this method, importance is placed mainly on the surface properties of the sintered material after machining for the purpose of de-gassing of a mold for plastic moldings. This eventually leads to a deficiency in that the particles and the fibers are complicatedly entangled in the inside of the sintered material obtained by the method, so that it is unlikely to obtain a gas permeability corresponding to a porosity. Moreover, limitation is placed on machining or use conditions in order to avoid clogging during the course of processing into a desired shape. The necessity of the metallic short fibers as one of the starting materials incurs high cost. In addition, uniform mixing of the metallic fibers and the carbon or metallic powder is difficult, with the attendant problem that it is not likely to obtain a material whose open pores are uniformly dispersed therethrough owing to the non-uniformity in the mixture. This is serious especially in the case where a large-sized material is fabricated.

On the other hand, air-permeable castings used as a material for machines and tools are usually made by a method wherein a ceramic material is charged and solidified in a resin polymer net, after which an iron melt is cast, thereby making porous castings by the action of the gas generated from the polymer net.

However, the cast material obtained by the method has an average diameter of open cells or voids undesirably as great as approximately 100 $\mu$m, with poor machined surface properties. If such a cast material is employed in the field of plastic moldings especially at portions where contacted with plastic resins such as for de-gassing in a mold at the time of injection molding and for in-mold film fixing, the resin is most likely to penetrate into the open pores. Thus, the cast material is not suitable for this purpose. In order to overcome the above disadvantage, an attempt has been made to improve the surface properties by spray coating, inviting an increase in cost.

SUMMARY OF THE INVENTION

Accordingly, an object of the invention is to provide a novel method for making a porous sintered material having good strength and surface processability and also having a desired porosity without use of any specific type of starting material such as metallic fibers. Another object of the invention is to provide a novel method which utilizes an HIP (hot isostatic press) molding technique which is used primarily for the purposes of making defect-free, high density, powdery products.

According to a preferred embodiment of the invention, there is provided a method for making a sintered material which comprises setting a capsule, which contains a starting powder in a hermetically sealed condition, in a pressure-resistant container, and subjecting the capsule to a combination of a treatment wherein the capsule is heated according to a predetermined temperature pattern and a treatment wherein the capsule is subjected to hot isostatic pressing by introducing a pressurized gas into the pressure-resistant container, characterized in that the pressure in the pressure-resistant container is arrived at a maximum level substantially in coincidence with the commencement of a sintering temperature-applying period in the temperature pattern, and the pressure is gradually decreased from the maximum level during the sintering temperature-applying period.

The sintered material obtained according to the method set out above can be made within a short time as being suppressed from excessive densification and having pores open to the outside with a desired porosity depending on the sintering temperature and the maximum pressure level. The sintered material has good strength and good surface processability without use of any specific type of starting material such as metallic fibers.

A further object of the invention is to provide a method for making a porous sintered material wherein continuous pores open to the outside are uniformly dispersed throughout the inside thereof.

A still further object of the invention is to provide a method which is able to improve the productivity of the above-mentioned porous sintered material.

These and other objects and many of the attendant advantages of this invention will be readily appreciated as the same becomes better understood by reference to the following detailed description when considered in connection with the accompanying drawings.

DESCRIPTION OF THE PREFERRED EMBODIMENTS

Examples of the invention are described with reference to the accompanying drawings.

EXAMPLE 1

Figure 1:
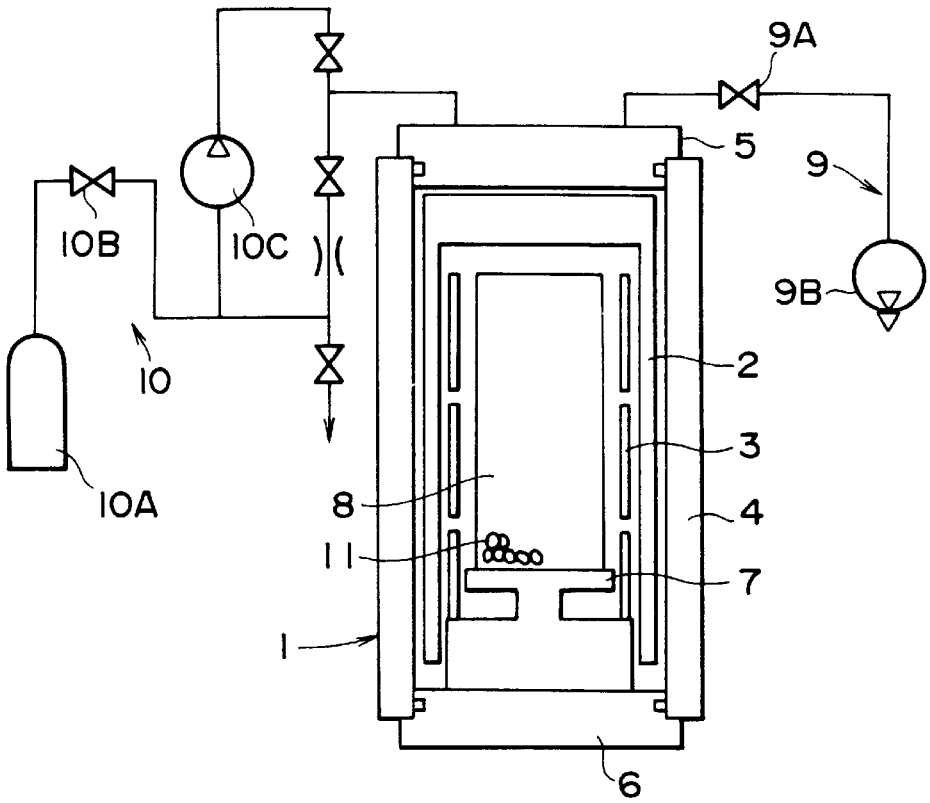
FIG. 1 is an illustrative view of an HIP device used to carry out the method of the invention.

FIG. 1 shows a hot isostatic pressing device (HIP device) for carrying out the method of the invention. The HIP device includes a pressure-resistant container 1, a heat-insulating layer 2 which is in the form of a hollow cylinder closed at an upper end thereof and is contained in the container 1, and a heater 3 built in the heat-insulating layer 2. The pressure-resistant container 1 has a hollow cylinder body 4, and upper and lower covers 5, 6 detachably attached to upper and lower openings of the body 4, respectively. A support 7 is disposed on the lower cover 6, on which a capsule to be treated is mounted.

The capsule 8 is packed with a metallic powder 11 and sealed after de-gassing. Where a Fe-based material is used as the metallic powder, the capsule 8 is made of a soft, high melting metal sheet such as of a soft steel, a stainless steel or the like. It will be noted that the pressure-resistant container is detachably held with a press frame (not shown) in order to support a force axially exerted on the upper cover 5 and the lower cover 6.

The pressure-resistant container 1 is connected to a vacuum device 9 and a high pressure gas generator 10. The vacuum device 9 is provided with a stop valve 9 and a vacuum pump 9B. The high pressure gas generator 10 is furnished with a gas bomb or cylinder 10A, a high pressure valve 10B and a gas compressor 10C. The high pressure gas generator 10 shown in the figure is of the differential pressure collection type, but may be of either a forced collection type or a non-collection type.

The pressure-resistant container is evacuated to vacuum by means of the vacuum device 9, after which a pressurized gas made of an inert gas such as argon, nitrogen or the like is introduced from the high pressure gas generator 10. The container is heated by passing an electric current to the heater 3. The pressure in the container by the introduction of the pressurized gas and the heating temperature are, respectively, varied according to a pressure pattern and a temperature pattern (hereinafter referred to simply as treating patterns), under which the metallic powder 11 packed in the capsule 8 is subjected to hot isostatic pressure treatment (hereinafter referred to simply as HIP treatment).

In Example 1, a stainless steel powder (average particle size of 100 $\mu$m) made by a gas atomization method and having a particle size of 250 $\mu$m or below was used as the metallic powder 11. The capsule 8 was made of a soft iron or a stainless steel (SUS), with an inner diameter of 120 mm and a height of 100 mm. In Example 1, eight capsules were, respectively, packed with the metallic powder 11 at a packing rate of 68±2%, followed by de-gassing and hermetic sealing at 150° C., thereby providing eight samples numbered as No. 1 to No. 8. Initially, sample Nos. 1 and 2 were each subjected to the HIP treatment according to the treating patterns shown in FIG. 2.

The temperature change in the treating patterns is first described. As shown by the solid line of FIG. 2, the sample is heated to a sintering temperature, Ts, in 2 hours from commencement of the heating and maintained for a predetermined time, Mts, (which time is hereinafter referred to as a sintering temperature period) at the sintering temperature, Ts, followed by cooling down to a temperature in the vicinity of room temperature in about 1 hour. On the other hand, with the pressure change, as shown by the broken line of FIG. 2, the pressure starts to be increased, simultaneously with the commencement of the heating, and is caused to arrive at a sintering pressure, Ps, at the time of commencement of the sintering temperature-applying period, Mts. Immediately after the arrival at the pressure, it is dropped down so that the pressure peak appears at the time of the commencement of the sintering temperature-applying period, Mts. Thereafter, the pressure is decreased to about zero while the temperature is cooled down to the vicinity of room temperature.

When the metallic powder is kept over the entire sintering temperature-applying period, Mts, under conditions where a high pressure is being applied, the resultant sintered material becomes excessively densified.

In the treating patterns, the sintering pressure is arrived at a maximum level, Ps, at the time of the commencement of the sintering temperature-applying period, Mts. Immediately after the arrival of the maximum level, the pressure is dropped.

According to the treating patterns, the HIP treatment of Sample No. 1 was conducted while setting the sintering temperature, Ts, at 950° C., the sintering temperature-applying period, Mts, at 0.5 hours, and the sintering pressure, Ps, at 50 MPa as shown in Table 1 below.

TABLE 1

Figure 2:
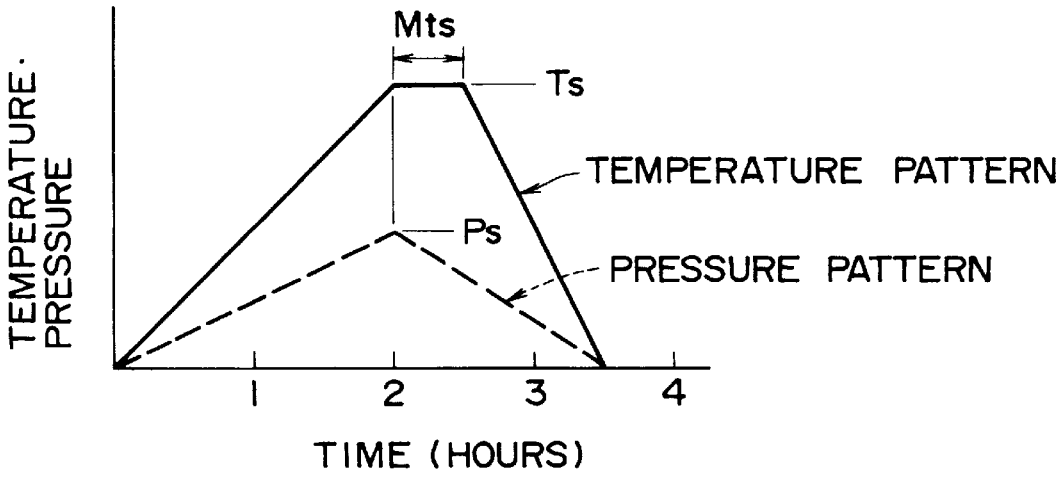
FIG. 2 is a graph showing temperature and pressure patterns used in the HIP treatment in Example 1 of the invention.

| | HIP Treating Conditions | | | | Average |
|---|---|---|---|---|---|
| Sample No. | Treating Patterns | Ts (°C.) | Mts (hr) | Ps (MPa) | Porosity (%) |
| 1 | FIG. 2 | 950 | 0.5 | 50 | 20.2 |
| 2 | FIG. 2 | 1000 | 0.5 | 50 | 16.2 |

After completion of the HIP treatment, the capsule taken out from the HIP device was removed by machining to obtain the resultant sintered material therefrom. The sintered material was subjected to measurement of porosity. The measurement was effected such that the sintered material was transversely cut at center of the height (i.e. cut at ½ of the height), from which test five pieces were sampled at equal intervals along the radial direction. The porosity of the samples at the respective portions was measured, from which an average value was calculated.

The average porosity, ϵ, of the sintered material of Sample No. 1 was found to be 20.2%. It was also found that the sintered material had a multitude of pores open to the outside substantially uniformly dispersed throughout the material.

Sample No. 2 was treated under the same conditions as Sample No. 1 except that the sintering temperature, Ts, was raised from 950° C. to 1000° C. The resultant sintered material had an average porosity, ϵ, of 16.2% and was thus denser than that of Sample No. 1.

Figure 3:
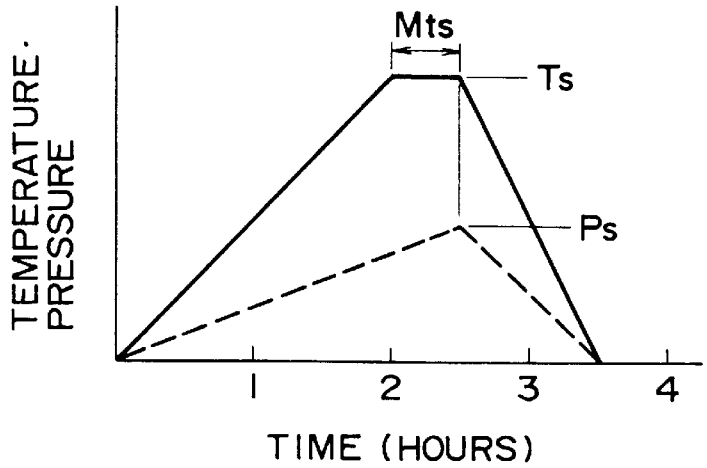
FIG. 3 is a graph showing further temperature and pressure patterns used in the HIP treatment in Example 1 of the invention.

Next, Sample Nos. 3 to 5 were each subjected to the HIP treatment according to the treating patterns shown in FIG. 3. The treating patterns are similar to those of FIG. 2 except that the time at which the pressure arrived at the sintering pressure, Ps, was at the completion of the sintering temperature-applying period Mts.

According to the treating patterns, Sample No. 3 was objected to the HIP treatment while setting the sintering temperature, Ts, at 950° C., the sintering temperature-applying period, Mts, at 0.5 hours and the sintering pressure, Ps, at 50 MPa as shown in Table 2. The sintered material of Sample No. 3 obtained by the treatment had an average porosity, ϵ, of 16.2%. Like the foregoing materials, the sintered material had a multitude of pores communicating to outside.

TABLE 2

Figure 4:
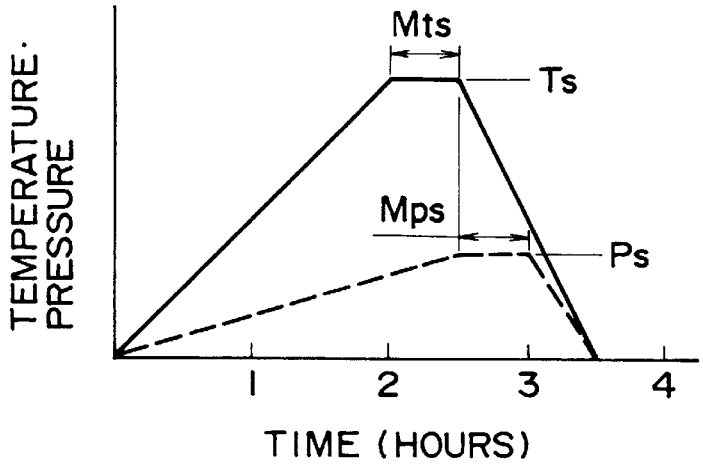
FIG. 4 is a graph showing still further temperature and pressure patterns used in the HIP treatment in Example 1 of the invention.

| | HIP Treating Conditions | | | | | Average |
|---|---|---|---|---|---|---|
| Sample No. | Treating Patterns | Ts (°C.) | Mts (hr) | Ps | Mps (MPa) | Porosity (%) |
| 3 | FIG. 3 | 950 | 0.5 | 50 | — | 16.2 |
| 4 | FIG. 3 | 900 | 0.5 | 50 | — | 20.2 |
| 5 | FIG. 3 | 950 | 0.5 | 30 | — | 20.5 |
| 6 | FIG. 4 | 950 | 0.5 | 30 | 0.5 | 17.2 |

Sample No. 4 was treated under the same conditions as Sample No. 3 except that the sintering temperature, Ts, was decreased from 950° C. to 900° C. The sintered material had an average porosity, ϵ, of 20.2% and was more porous than that obtained from Sample No. 3.

Sample No. 5 was treated under the same conditions as Sample No. 3 except that the sintering. pressure, Ps, was decreased from 50 MPa to 30 MPa. The sintered material had an average porosity, ϵ, of 20.5% and was more porous than that obtained from Sample No. 3.

Then, Sample No. 6 was subjected to the HIP treatment according to the treating patterns shown in FIG. 4. The treating patterns differ from those patterns of FIG. 3 in that during the course where the pressure was dropped after arrival at the sintering pressure, Ps, the sintering pressure, Ps, was maintained for a given period, Mps, to form a plateau of the pressure.

According to these treating patterns, Sample No. 6 was subjected to the HIP treatment under the same conditions as Sample No. 5 except that the sintering temperature, Ts, was set at 950° C., the sintering temperature-applying period, Mts, was set at 0.5 hours, and the sintering pressure, Ps, at 30 MPa as shown in Table 2 while maintaining the sintering pressure, Ps, for 0.5 hours. The resultant sintered material had an average porosity, or of 17.2% and was denser than that of Sample No. 5.

Figure 5:
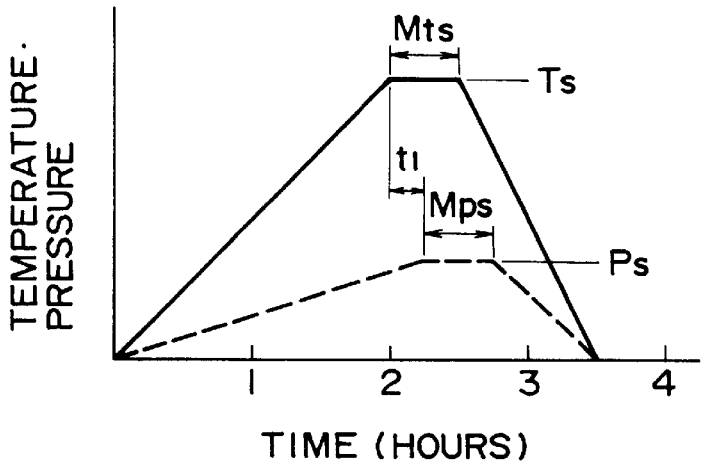
FIG. 5 is a graph showing yet further temperature and pressure patterns used in the HIP treatment in Example 1 of the invention.

Sample No. 7 was subjected to the HIP treatment according to the treating patterns shown in FIG. 5. In the treating patterns, the time of arriving at the sintering pressure, Ps, is delayed by a time, $t_1$, after commencement of the sintering temperature-applying period, Mts, and thus, the sintering pressure, Ps, is arrived during the sintering temperature-applying period, Mts, and maintained thereat over a given period, Mps, after the arriving time. The other conditions are same as those of the patterns of FIG. 4.

According to the treating patterns, Sample No. 7 was subjected to the HIP treatment under conditions set at a sintering temperature, Ts, of 1000° C., a sintering temperature-applying period, Mts, of 0.5 hours and a sintering pressure, Ps, of 30 MPa, wherein the time of arriving at the sintering pressure, Ps, was set 0.25 hours after commencement of the sintering temperature-applying period, Mts, and the sintering pressure, Ps, was maintained for 0.5 hours. The resultant sintered material had an average porosity, ϵ, of 17.2%.

TABLE 3

Figure 6:
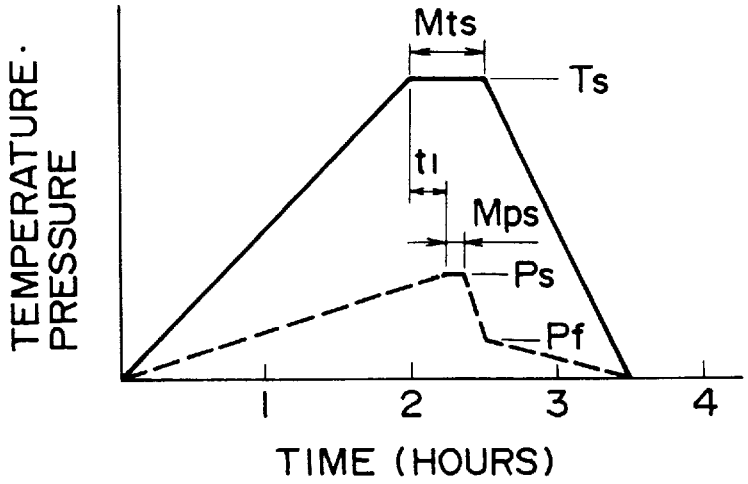
FIG. 6 is a graph showing further temperature and pressure patterns used in the HIP treatment in Example 1 of the invention.

| Sam- | HIP Treating Conditions | | | | | | | Average |
|---|---|---|---|---|---|---|---|---|
| ple No. | Treating Patterns | Ts (°C.) | Mts (hr) | $t_1$ (hr) | Ps (MPa) | Pps (hr) | Pf (MPa) | Porosity (%) |
| 7 | FIG. 5 | 1000 | 0.5 | 0.25 | 30 | 0.5 | — | 17.2 |
| 8 | FIG. 6 | 1000 | 0.5 | 0.25 | 30 | 0.1 | 10 | 20.5 |

Sample No. 8 was then subjected to the HIP treatment according to the treating patterns shown in FIG. 6. Like the treating patterns of FIG. 5, the treating patterns involved the arrival at the sintering pressure, Ps, at the time delayed by a time, $t_1$, after commencement of the sintering temperature-applying period, Mts, but the time, Mps, maintained at the sintering pressure Ps is shorter than that of FIG. 5 and the pressure is dropped immediately. At the time of completion of the sintering temperature-applying period, Mts, the pressure is set at a given pressure Pf which is lower than the sintering pressure, Ps, from which it is gradually decreased to approximately zero.

According to the treating patterns, Sample No. 8 was subjected to the HIP treatment under conditions of a sintering temperature, Ts, of 1000° C., a sintering temperature-applying period, Mts, of 0.5 hours, a sintering pressure, Ps, of 30 MPa, and a delayed time of arriving at the sintering pressure, Ps, of 0.25 hours as in Sample No. 7 but using a sintering pressure-maintaining period, Mps, of about 0.1 hour and a pressure, Pf, at the completion of the sintering temperature-applying period, Mts, of 10 MPa. The resultant sintering material had an average porosity, ϵ, of 20.5% and was found to be more porous than that obtained from Sample No. 7.

As will be appreciated from the foregoing, Example 1 deals with the treatments wherein a peak of pressure is established just at the time of commencement of the sintering temperature-applying period, Mts, or a peak or short-time plateau of pressure is formed during or at the time of completion of the sintering temperature-applying period, Mts.

The sintering process of metallic particles is illustrated with reference to FIGS. 7 to 11.

Figure 7:
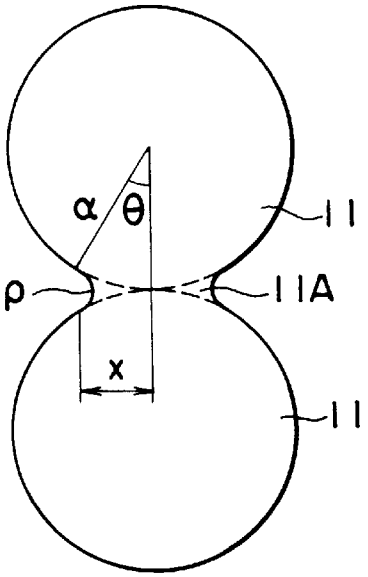
FIG. 7 is a schematic view illustrating a bonding model wherein the distance between the centers of metallic particles is constant.
Figure 8:
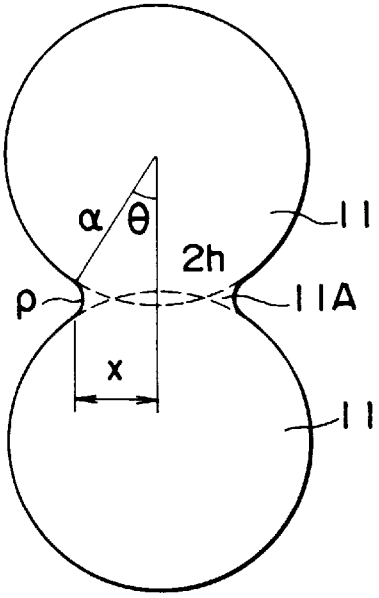
FIG. 8 is a schematic view illustrating a bonding model wherein the distance between the centers of metallic particles decreases.

As shown in FIG. 7, the sintering process of metallic particles 11 includes a first stage wherein neck portions 11A of two particles increase in area owing to the surface diffusion occurring around contact portions of the particles and bond to each other. In the case, no dimensional change takes place and the resulting sintered material has low strength, In a second stage, mutual mass movement between the particles takes place as shown in FIG. 8, by which the distance between the centers of the particles reduces, thereby causing shrinkage. As a matter of course, the neck portions 11A become thick, resulting in the increase of strength. This phenomenon is a so-called atomic void diffusion phenomenon where voids in individual particles (i.e. spaces deficient of the atoms) are moved toward the particle surface. This eventually leads to the shrinkage of the two atoms, resulting in the shrinkage of the entire particle layer.

Figure 9:
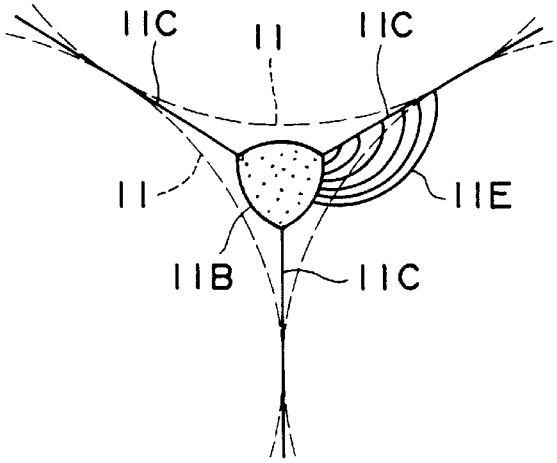
FIG. 9 is a view illustrating a model of diffusion during the course of sintering.

As the sintering further proceeds, the particles are combined together while a space 11B between the particles which exists from the first as shown in FIG. 9 is gradually rounded in shape and takes the voids therein. The space 11B further moves along a grain boundary 11C and is released to outside while continuing shrinkage, resulting in the formation of a denser material. In FIG. 9, reference numeral 11E indicates diffusion fluxes of the atom.

The progress of the sintering process is greatly influenced by the sintering temperature and timer. In prior art sintering processes, a press molding which has been preliminarily made by any appropriate means is sintered in a vacuum furnace or an atmospheric furnace. In the case, when using a higher sintering temperature or a longer sintering time, sintering more proceeds. Although depending on the size of particles, the sintering commencing temperature is usually within a range of 0.4 to 0.5 of a melting temperature as expressed in terms of absolute temperature and is 630° C. for iron and approximately 400° C. for copper. The sintering temperature is generally set at about 900° to 1050° C. for Fe-based materials.

Figure 10:
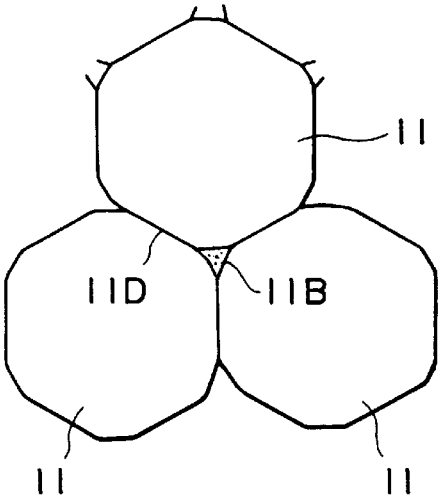
FIG. 10 is a view illustrating a sintered model accompanied by the pressing in an ordinary HIP treatment.
Figure 11:
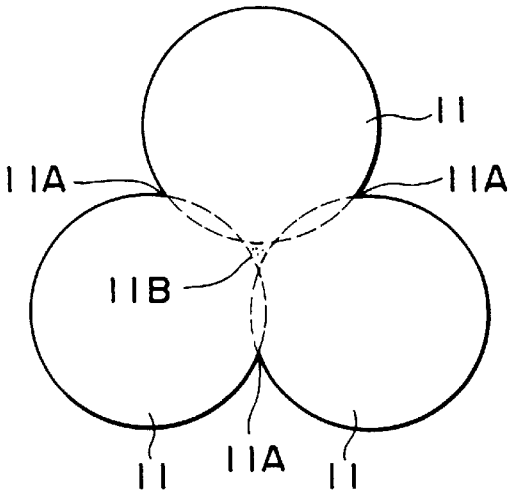
FIG. 11 is a view illustrating a sintered model by the pressurization in the HIP treatment of the invention.

In contrast, where molding and sintering are conducted at the same time while pressing as in hot pressing or HIP molding, the particles are more susceptible to plastic deformation as the temperature rises. Thus, the area of contact between adjacent particles increases at an initial stage of sintering under which the sintering proceeds more readily. If, however, the pressure is high but the temperature is low, the resulting material has an increasing apparent density. Nevertheless, the particles undergo only plastic deformation as 11D as shown in FIG. 10. The resultant sintered material is inferior in strength and surface processability to that as shown in FIG. 11. Thus, an intended product cannot be obtained. Accordingly, where the sintering is effected under pressure, it is necessary that the sintering temperature, Ts, be higher than the sintering commencing temperature.

Hence, the sintering temperature in Example 1 is set at about 900° C. to 1000° C. within which the temperature pattern has been determined. In contrast, the pressure pattern is so set as having been set forth hereinbefore. More particularly if a high pressure is maintained over the entire sintering temperature-applying period, Mts, the particles undergo plastic deformation simultaneously with sintering, and thus, excessive densification proceeds, making it difficult to obtain an intended porous sintered material. To avoid this, the sintering is caused to proceed and be facilitated while bringing them to come closer to one another by application of pressure. The pressure, Ps, is not maintained over the entire period during which the sintering temperature, Ts, is applied, but is applied immediately before or after the period, or within a short time during the period.

According to this treatment, when the pressure and temperature and the times for keeping both are individually changed, a sintered material is obtained as having a desired porosity and good strength and surface processability. The results of a permeability test which was conducted separately from this example, revealed that little permeability was observed when the porosity was less than 10%, and openings continuously communicated with the inside disappeared. In this sense, in order to obtain a sintered material having good permeability, it is necessary that the porosity be at least 10% or over. In this example, metallic materials can be obtained as having a desired porosity of not less than 10% and having continuous pores open to the outside thereby ensuring good air and moisture permeabilities.

Especially, in the treatment where the pressure reaches a sintering pressure, Ps, during the course of the sintering temperature-applying period, Mts, a predetermined temperature is reached prior to the application of a high pressure load. Accordingly, the first part of the sintering temperature-applying period, Mts, serves for preliminary sintering, during which the packed metallic particle layer has a uniform distribution of temperature in the inside thereof. In this condition, if the sintering of the particles which come close to one another under pressure is caused to proceed and be facilitated, the metallic particles are not excessively sintered or are partially left as being not sintered owing to the irregularity of the temperature, thereby obtaining a uniform, porous sintered metallic material.

EXAMPLE 2

In Example 2, eight samples numbered as Nos. 9 to 16 were made in the same manner as in Example 1. These samples were, respectively, subjected to the HIP treatment according to the treating patterns shown in FIGS. 12 to 14, respectively. Example 2 was conducted in the same manner as in Example 1 except that the treating patterns used differ from those of Example 1, i.e. other conditions and the measurement of the average porosity, $\epsilon$, were as in Example 1.

Figure 12:
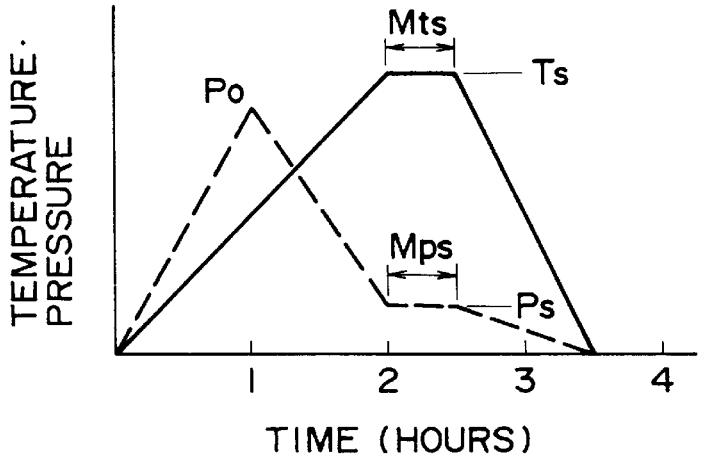
FIG. 12 is a graph showing temperature and pressure patterns used in the HIP treatment in Example 2 of the invention.

FIG. 12 shows the treating patterns adopted for Sample Nos. 9 to 12. The temperature change in the treating patterns is the same as in Example 1. More particularly, a sintering temperature, Ts, is reached in about 2 hours and is maintained over a sintering temperature-applying period, Mts, after which the temperature is decreased to a temperature in the vicinity of room temperature in about 1 hour. On the other handy the pressure is so changed that it is raised substantially at the same time as the temperature starts to be raised and is reached at a pretreating pressure of Po in about 1 hour. Immediately after reaching the pressure, Po, the pressure is dropped thereby forming a peak of the pressure and leads to a sintering pressure, Ps, at the time of commencement of the sintering temperature-applying period, Mts. Subsequently, the pressure, Ps, is maintained over a given time, Mps, (hereinafter referred to as sintering pressure-applying period), thereby forming a plateau of the pressure, followed by decrease close to zero.

In the treating patterns, the metallic powder 11 is more densified by application of the pretreating pressure, Po, higher than the sintering pressure, Ps, prior to arrival at the sintering temperature, Ts. Thereafter, sintering is conducted at the sintering pressure, Ps, which is set at a lower level not to cause excessive densification.

According to the treating patterns, Sample No. 9 was subjected to the HIP treatment wherein the sintering temperature was set at 1000° C., the sintering temperature-applying period set at 0.5 hours, the pretreating pressure, Po, set at 100 MPa., the sintering pressure, Ps, set at 10 MPa, and the sintering pressure period, Mps, set at 0.5 hours like Mts, as shown in Table 4. The sintered material of Sample No. 9 obtained by the treatment had an average porosity, ϵ, of 22.4%. The sintered material was found to have a multitude of pores communicating to outside substantially uniformly, like individual sintered materials obtained in Example 1.

TABLE 4

| Sample No. | HIP Treating Conditions: Treating Patterns | Ts (°C.) | Mts (hr) | Po (MPa) | Ps (MPa) | MPs (hr) | Average Porosity (%) |
|---|---|---|---|---|---|---|---|
| 9 | FIG. 12 | 1000 | 0.5 | 100 | 10 | 0.5 | 22.4 |
| 10 | FIG. 12 | 1000 | 1 | 100 | 10 | 0.5 | 19.5 |
| 11 | FIG. 12 | 1000 | 0.5 | 100 | 20 | 0.5 | 18.4 |
| 12 | FIG. 12 | 1000 | 0.5 | 100 | 10 | 1 | 20.1 |

Sample No. 10 was sintered in the same manner as Sample No. 9 except that the sintering temperature-applying period, Mts, was prolonged from 0.5 hours to 1 hour. The resultant sintered material had an average porosity, ϵ, of 19.5% and was thus slightly denser than that of Sample No. 9.

Sample No. 11 was sintered in the same manner as Sample No. 9 except that the sintering pressure, Ps, was increased from 10 MPa to 20 MPa. The resultant sintered material had an average porosity, ϵ, of 18.4% and was thus slightly denser than that of Sample No. 9.

Sample No. 12 was sintered in the same manner as Sample No. 9 except that the sintering pressure-applying period, Mps, was set at 1 hour and the sintering pressure, Ps, was maintained for 0.5 hours during the commencement of the temperature drop after passage of the sintering temperature-applying period, Mts. The resultant sintered material had an average porosity, ϵ, of 20.1%.

Figure 13:
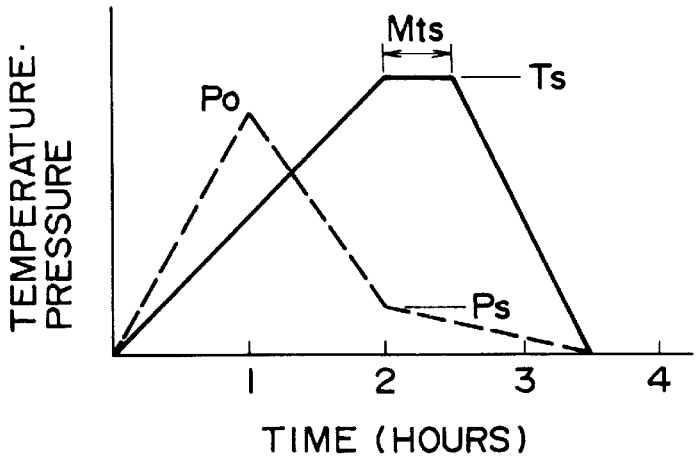
FIG. 13 is a graph showing further temperature and pressure patterns used in the HIP treatment in Example 2 of the invention.

Sample Nos. 13 to 15 were, respectively, subjected to the HIP treatment according to the treating patterns shown in FIG. 13. The treating patterns differ from those patterns of FIG. 12 in that the sintering pressure-applying period, Mps, was not furnished. More particularly, the pressure is dropped from the pretreating pressure, Po, to the sintering pressure, Ps, when the sintering temperature-applying period, Mts, commences. Moreover, the pressure is gradually lowered during the sintering temperature-applying period, Mts, without formation of any plateau of the pressure, Ps, and is brought to nearly zero at the time when the temperature reaches substantially room temperature.

According to the treating patterns, Sample No. 13 was subjected to the HIP treatment under the same conditions as Sample No. 9 including a sintering temperature, Ts, of 1000° C., a sintering temperature-applying period, Mts, of 0.5 hours, a pretreating pressure, Po, of 100 MPa, and a sintering pressure, Ts, of 10 MPa. The resultant sintered material had an average porosity, ϵ, of 23.6% and was found to be slightly more porous than that from Sample No. 9. The material had a multitude of pores communicating to outside formed substantially uniformly.

TABLE 5

| Sample No. | HIP Treating Conditions: Treating Patterns | Ts (°C.) | Mts (hr) | Po (MPa) | Ppo (hr) | Ps (MPa) | Average Porosity (%) |
|---|---|---|---|---|---|---|---|
| 13 | FIG. 13 | 1000 | 0.5 | 100 | — | 10 | 23.6 |
| 14 | FIG. 13 | 1000 | 1 | 100 | — | 10 | 19.5 |
| 15 | FIG. 13 | 1000 | 0.5 | 50 | — | 10 | 25.8 |
| 16 | FIG. 14 | 1000 | 0.5 | 100 | 0.5 | 10 | 21.5 |

Sample No. 14 was sintered in the same conditions as Sample No. 13 except that the sintering temperature-applying period, Mts, was prolonged from 0.5 hours to 1 hour. The resultant sintered material had an average porosity, ϵ, of 23.6% and was found to be slightly denser than that from Sample No. 13.

Sample No. 15 was sintered in the same conditions as Sample No. 13 except that the pretreating pressure, Po, was decreased from 100 MPa to 50 MPa. The resultant sintered material had an average porosity, ϵ, of 25.8% and was found to be more porous than that from Sample No. 13.

Figure 14:
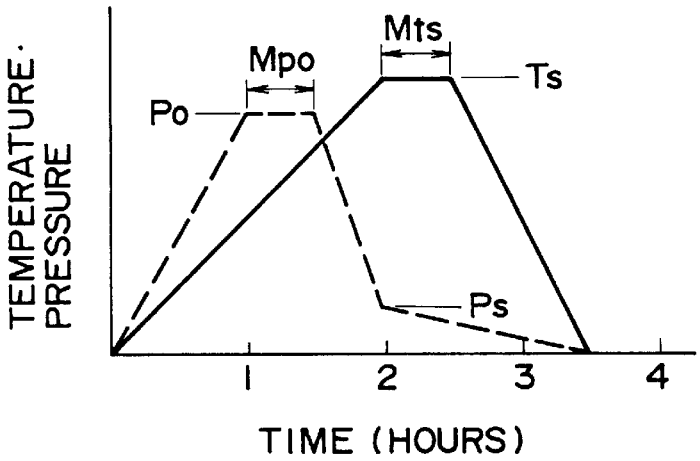
FIG. 14 is a graph showing still further temperature and pressure patterns used in the HIP treatment in Example 2 of the invention.

Sample No. 16 was subjected to the HIP treatment according to the treating patterns shown in FIG. 14. The treating patterns differ from those of FIG. 13 in that after arrival at a pretreating pressure, Po, in about 1 hour after commencement of the pressure rise, the pretreating pressure, Po, is maintained for a given time, Mpo, thereby forming a plateau of pressure prior to arrival at the sintering temperature, Ts.

According to the treating patterns, Sample No. 16 was subjected to the HIP treatment under the same conditions as Sample No. 13 including a sintering temperature, Ts, of 1000° C., a sintering temperature-applying period, Mts, of 0.5 hours and a sintering pressure, Ps, of 10 MPa, but a pretreating pressure, Po, of 100 MPa was applied for 0.5 hours. The resultant sintered material had an average porosity, ϵ, of 21.5% and was found to be slightly denser than that from Sample No. 13.

As will be apparent from the above, in Example 2, a peak or plateau of pressure is established by introduction of a pressurized gas prior to arrival at a given sintering temperature, Ts. When the given sintering temperature, Ts, is reached the pressure is lowered to diffusively combine the metallic powder under low pressure conditions. By application of the high pressure at low temperatures prior to arrival at the sintering temperature, Ts, the particles randomly packed in the capsule come closer to one another, thereby diminishing undesirably spaces which might bring about defects after sintering. Since contact points increase in number, subsequent sintering is facilitated. As a consequence, when the pressure and temperature or the times of maintaining both are individually changed, a sintering material can be made within a short time as having desired strength and surface processability and also having pores open to outside at a porosity not at least 10% or over.

EXAMPLE 3

For the purpose of further improving the uniformity of pores or voids formed in the porous sintered materials obtained by the HIP treatment, the following example is described.

In Example 3, stainless steel powder having a particle size of not greater than 250 μm and made by the gas atomizing method was used like Examples 1 and 2. The powder was sealed in a capsule to obtain eight samples numbered as 17 to 24. The sizes of the capsules and the types of materials for the capsules are shown in Table 6.

TABLE 6

| Sample No. | No. 17 | No. 18–21 | No. 22 | No. 23, 24 |
|---|---|---|---|---|
| Size (diameter × height ) mm | 460 × 550 | 216 × 250 | 114 × 100 | 216 × 250 |
| Material | Soft steel | SUS | SUS | SUS |

Figure 15:
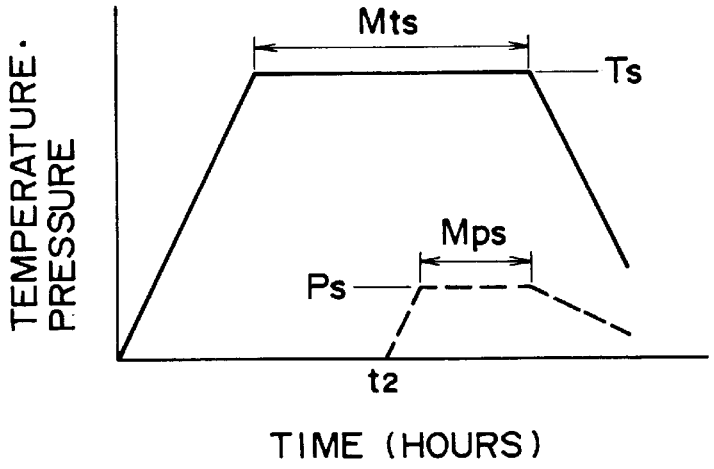
FIG. 15 is a graph showing temperature and pressure patterns used in the HIP treatment in Example 3 of the invention.
Figure 16:
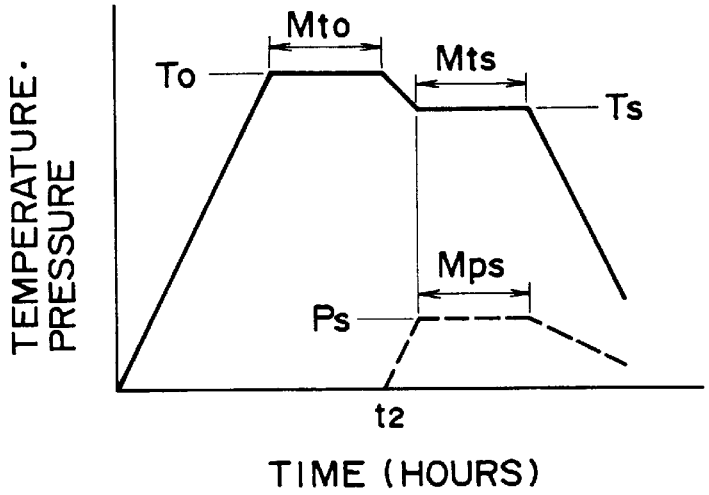
FIG. 16 is a graph showing further temperature and pressure patterns used in the HIP treatment in Example 3 of the invention.
Figure 17:
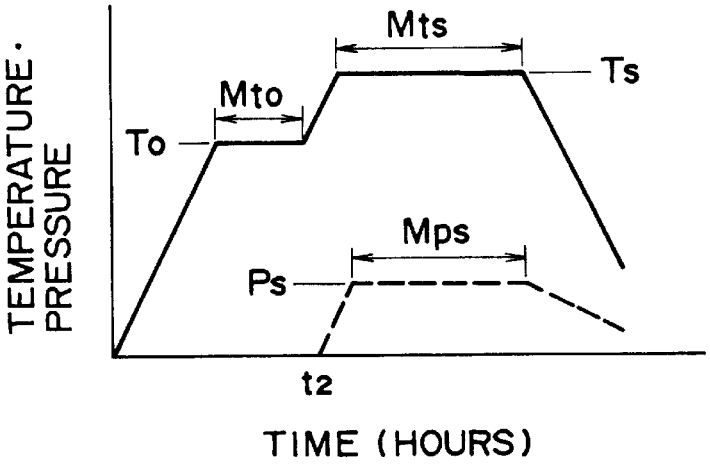
FIG. 17 is a graph showing still further temperature and pressure patterns used in the HIP treatment in Example 3 of the invention.

Among these samples, Sample Nos. 17 to 22 were, respectively, subjected to the treating patterns shown in FIGS. 15 to 17. In example 3, only the treating patterns differ from those of Example 1 but other conditions and the measurement of the average porosity, ϵ, were as in Example 1.

FIG. 15 shows the treating patterns adopted for Sample Nos. 17 and 18. In the treating patterns, the temperature is raised at a rate of approximately 400° to 600° C./hour to a sintering temperature, Ts, which is maintained for a sintering temperature-applying period, Mts, followed by descending the temperature. On the other hand, the pressure starts to rise a time, $t_2$, after commencement of the temperature rise. When the pressure arrives at a given sintering pressure, Ps, it is maintained for a time, Mps, of about 1 to several hours, thereby forming a plateau of pressure, followed by dropping the pressure substantially simultaneously with the commencement of the temperature descent In the treating patterns, the pressure starts to increases after a give sintering temperature-applying period, Mts. This means that an atmospheric pressure is exerted before commencement of the pressure rise during the sintering temperature-applying period, Mts. In this condition, the particles are heated to the sintering temperature, Ts, and maintained at the sintering temperature, Ts, for a given time before commencement of the pressure rise. During this period, the metallic powder in the capsule is entirely, uniformly soaked at the sintering temperature, Ts. After the powder has been soaked, the pressure starts to rise to the sintering level, Ps, thereby facilitating the diffusional bonding of the metallic powder.

According to the treating patterns, Sample No. 17 was subjected to the HIT treatment under conditions including, as shown in Table 7, a sintering temperature, Ts, of 950° C., a sintering temperature-applying period, Mts, of 26 hours, a time, $t_2$, of from commencement of raising the temperature before commencement of raising pressure of 24 hours, a sintering pressure, Ps, of 220 MPa, and a sintering pressure-applying period, Mps, of 2 hours. The resulting sintered material had an average porosity, ϵ, of 12.8%.

Sample No. 18 was treated under the same conditions as Sample No. 17 except that the sintering temperature-applying period, Mts, was set at 3 hours, the time, $t_2$, of from commencement of raising the temperature before commencement of raising the pressure set at 2 hours, and the sintering pressure-applying period, Mps, set at 1 hour. The resulting sintered material had an average porosity, ϵ, of 15.5%, Sample Nos. 19 and 20 were, respectively, subjected to the HIP treatment according to the treating patterns shown in FIG. 16. In the patterns, the furnace temperature was once raised to a pretreating temperature, To, of approximately a sintering temperature, Ts, + (a temperature of 150° C. or below) and maintained for a time of Mto. Thereafter, the furnace temperature was lowered to the sintering temperature, Ts, which was held for a sintering temperature-applying period, Mts. In the case, the time, $t_2$, of commencing the pressure rise is set between the time of starting the temperature descent from the pretreating temperature, To, and the time of arriving at the sintering temperature, Ts, in order that the time of arrival at the sintering pressure, Ps, is substantially coincident with the time of starting the sintering temperature-applying period, Mts.

According to such treating patterns as set out above, Sample No. 19 was subjected to the HIP treatment under conditions of a treating temperature, To, of 1000° C., a holding time, Mto, of 1 hour, a sintering temperature, Ts, of 950° C., a sintering temperature-applying period, Mts, of 1 hour, a sintering pressure, Ps, of 20 MPa, and a sintering pressure-applying period, Mps, of 1 hour as shown in Table 7. The resulting sintered material had an average porosity, ϵ, of 15.8%.

Sample No. 20 was sintered under the same conditions as Sample No. 19 except that the holding time of the pretreating temperature, To, was prolonged from 1 hour to 2 hours. The resulting sintered material had an average porosity, ϵ, of 14.0%.

Sample Nos. 20 and 21 were each subjected to the HIP treatment according to the treating patterns shown in FIG. 17. The patterns were same as those patterns of FIG. 16 except that the pretreating temperature, To, was set at a level of sintering temperature, Ts, – (a temperature of 150° C. or below).

According to such treating patterns as set out above, Sample No. 21 was subjected to the HIP treatment under conditions of a treating temperature, To, of 800° C., a holding time, Mto, of 1 hour, a sintering temperature, Ts, of 950° C., a sintering temperature-applying period, Mts, of 2 hours, a sintering pressure, Ps, of 20 MPa, and a sintering pressure-applying period, Mps, of 2 hours as shown in Table 7. The resulting sintered material had an average porosity, ϵ, of 15.0%.

TABLE 7

| | HIP Treating Conditions | | | | | | | | |
|---|---|---|---|---|---|---|---|---|---|
| Sintered Material No. | Treating Patterns | To (°C.) | Mto (hr) | Ts (°C.) | Mts (hr) | $t_2$ (hr) | Ps (MPa) | Mps (hr) | Average Porosity (%) |
| 17 | FIG. 15 | — | — | 950 | 26 | 24 | 20 | 2 | 12.8 |
| 18 | FIG. 15 | — | — | 950 | 3 | 2 | 20 | 1 | 15.5 |
| 19 | FIG. 16 | 1000 | 1 | 950 | 1 | 2.7 | 20 | 1 | 15.8 |
| 20 | FIG. 16 | 1000 | 2 | 950 | 1 | 3.7 | 20 | 1 | 14.0 |
| 21 | FIG. 17 | 800 | 1 | 950 | 2 | 2.3 | 20 | 2 | 15.0 |
| 22 | FIG. 17 | 800 | 1 | 1100 | 2 | 3.3 | 10 | 1 | 10.5 |
| 23 | FIG. 12 | — | — | 1000 | 0.5 | 0 | 50 | 0 | 16.2 |
| 24 | — | — | — | 1000 | 2 | 0 | 20 | 2 | 12.2 |

Sample No. 22 was sintered under the same conditions as Sample No. 21 except that the sintering temperature, Ts, was increased to 1100° C., the sintering pressure, Ps, was lowered to 10 MPa, and the sintering pressure-applying period, Mps, was shortened to 1 hour. The resulting sintered material had an average porosity, $\epsilon$, of 10.5%.

Sample Nos. 23, 24 in Table 7 are for comparison in Example 3. In these comparative examples, the treatment is carried out according to a pattern where the pressure is increased simultaneously with commencement of the temperature rise and arrives at a sintering pressure, Ps, at the time when the temperature reaches a sintering temperature, Ts. More particularly, Sample No. 23 was subjected to the HIP treatment according to the treating pattern shown in FIG. 12 under conditions of a sintering temperature, Ts, of 1000° C., a sintering temperature-applying period, Mts, of 0.5 hours, and a sintering pressure of 50 MPa. The treating conditions of Sample No. 23 include a sintering temperature, Ts, of 1000° C., a sintering temperature-applying period, Mts, of 2 hours, a sintering pressure of 20 MPa, and a sintering pressure-applying period of 2 hours.

Figure 18:
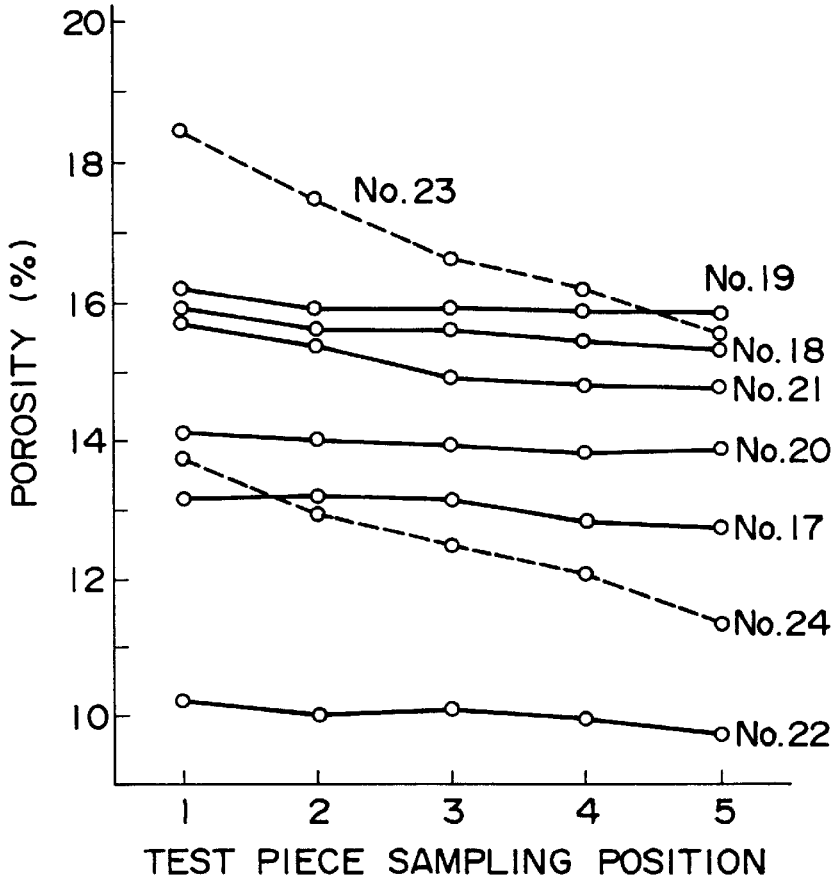
FIG. 18 is a graph showing the results of measurement of a porosity distribution along the radial direction of a sintered material obtained in Example 3.

The sintered materials obtained from Sample Nos. 17 to 24 have, respectively, pores open to outside in the inside thereof. FIG. 18 shows the results of measurement of a pore distribution for these sintered materials. These results are those obtained by the measurement wherein a sample was transversely cut at a center of the height (height×½) and five samples were sampled from the transverse section at equal intervals along the axial direction. The figures in the abscissa axis, respectively,,indicate the sampling positions which are numbered sequentially as 1 to 5 from the center toward the outer periphery, respectively.

From FIG. 18, it will be seen that the variation of the pores along the radial direction in Sample Nos. 17 to 22 is within a range of 0.5 to 1.0%. This means that these porous sintered materials are relatively homogeneous. Constant gas permeability is ensured using any portion of the sintered material. This eventually leads to the fact that articles, e.g. molds, obtained from the materials can be prevented from variation in quality.

In contrast, Sample Nos. 23, 24 which are provided as Comparative Examples exhibit a variation ranging from 2.4 to 3.0% along the radial direction. More particularly, the porosity tends to be higher at the central portion of the material and to be lower at circumferential portions.

As will be apparent from the above, in Example 3, the metallic powder in the capsule is entirely soaked. By the soaking, the powder is uniformly contacted and bonded at any portion in the capsule by application of a hot isostatic pressure, so that the sintered material is in a uniform voidage condition at any portion thereof. Thus, there can be obtained a porous sintered metal material having a uniform pore distribution.

With the treatment of raising and maintaining the furnace temperature to a pretreating temperature, To, which is higher than an intended sintering temperature, Ts, for soaking, a time required for the soaking can be shortened. In the case, the time of starting the pressure rise is set between the time of starting the temperature drop and the time of arriving at the sintering temperature, Ts, in order that the sintering pressure, Ps, appears substantially at the time when the sintering temperature, Ts, is reached. At that time, the difference between the pretreating temperature, To, and the sintering temperature, Ts, is approximately 150° C. or below. The metallic powder is kept substantially at the same temperature when the furnace temperature reaches the sintering temperature, Ts. Moreover, an average pressure before reaching the sintering pressure, Ps, is so low that its influence is negligible.

On the other hand, in the treatment of increasing and maintaining the furnace temperature at a pretreating temperature, To, which is higher than an intended sintering temperature, Ts, a great heating rate may be selected at the first stage, thus the time required for the soaking can be shortened. It will be noted that the commencement of the pressure rise is set so that the sintering pressure, Ps, develops substantially at the time of arriving at the sintering temperature, Ts.

In Example 3, a procedure where after the rise of pressure, a given sintering pressure is maintained for a sintering pressure-applying period, Mps, has been shown. As soon as the sintering pressure, Ps, is reached, it may be dropped while leaving the pressure as a peak (in which Mps=0). The maximum sintering temperature and pressure and the holding times therefor may be appropriately selected depending on the type of sintering material and the porosity, like the foregoing examples. The sintering temperature, Ts, may be maintained at least under conditions where a given treating pressure, Ps, is applied. After completion of the pressurizing treatment, the temperature is dropped simultaneously or separately with the removal of the pressure being applied.

EXAMPLE 4

In Example 3, the capsule was soaked prior to sintering under pressure. This example illustrates soaking in a device different from the HIP device.

A large-sized capsule takes a long time before soaking to the center thereof. Accordingly, heating in the HIP device leads to a lowering of productivity, thus being not beneficial.

In such a case, an appropriate heating furnace (atmospheric furnace) is provided, aside from the HIP device, for carrying out the heating and soaking steps. By this, the capsule is preliminarily heated to a temperature in the vicinity of the sintering temperature, Ts, and is charged into the HIP device where it is subjected to the HIP treatment, like Example 3, thereby enabling one to efficiently make sintered materials.

A typical example is described. A stainless steel powder (average particle size of 100 $\mu$m) made by the gas atomizing method in a manner similar to those of the foregoing examples was provided as a metallic powder. 480 kg of the powder was packed at a packing rate of 72% in a soft steel capsule having a diameter of 320 mm, a height of 1200 mm and an inner capacity of 87196 $cm^3$. Subsequently, while heating to 400° C., the capsule was de-gassed to a level on the order of 0.1 Pa and hermetically welded.

Figure 19:
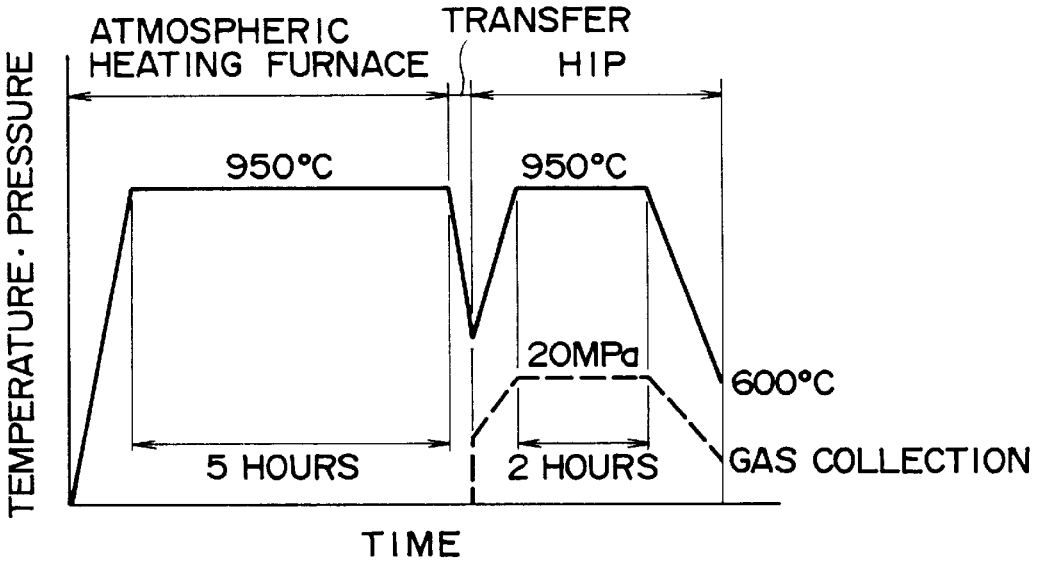
FIG. 19 is a graph showing temperature and pressure patterns in the HIP treatment in Example 4 of the invention.

The thus de-gassed and welded capsule in which the powder had been packed was treated according to the pattern shown in FIG. 19. The capsule was charged into an atmospheric heating furnace where it was heated to 950° C. and held for 5 hours. Next, the capsule was removed from the heating furnace, and was transferred to and charged into the HIP device which had been preheated to approximately 700° C. The temperature rise started in the HIP device and the capsule was again heated to 950° C. Simultaneously, the pressure was raised to 20 MPa.

This temperature-pressure condition was maintained for 2 hours so that the metallic powder was caused to diffusionally bond together. Thereafterf the heating was stopped, and it was started to drop the temperature through natural cooling along with the drop of the pressure. When arriving at a gas collection temperature (e.g. 600° C.), the gas was collected from the HIP device and the pressure was returned to an atmospheric pressure, followed by removal of the capsule.

By the treatment, a large-sized sintered material could be obtained as havihg a uniform porosity, like Example 3.

In the foregoing examples 1 to 4, the metallic particles filled in the capsule are packed fundamentally based on a single-layered packing or a mixed packing using a coarse powder having an average size of 100 μm (maximum size: 250 μm) and a fine powder having an average size of 45 μm. The sizes of these powders were measured using a laser-type size analyzer. This analyzer is a commercially available measuring instrument ordinarily used for this purpose, and the measuring method and data are reliable.

On the other hand, a capsule 8 may be so packed that a fine particle layer of the metallic powder 11 is formed at the upper portion or bottom portion or both of the capsule, and a coarse particle layer made of particles having an average size greater than in the fine particle layer is packed in the other portions.

This is more particularly described. A gas-atomized powder of a stainless steel having an average size of 100 μm (maximum size: 220 μm) was initially packed in a stainless steel capsule (dimension: 120 mm in diameter and 120 mm in height), and then vibrated so that the powder-packed layer in the capsule was brought as close to closest packing as possible. Thereafter, a metallic powder having an average particle size of 45 μm was packed to form a fine powder layer, followed by de-gassing in vacuum and hermetic welding. The capsule was set in the HIT device and was loaded with a uniform pressure from outside of the capsule by application of a pressurized gas according to the pressure and temperature patterns having set out hereinbefore. The capsule was heated to a predetermined level and held for a given time, followed by cooling of the capsule with a gas. The sintering temperature was set at 1000° C. and the sintering pressure was set at 10 MPa.

The microscopic observation of the section of the resulting sintered material reveals that the layer between the fine particle layer and the coarse particle layer is continuously combined. Although the fine particle layer is disturbed or curved, a given thickness is ensured. Additionally, the surface portion is formed of the fine particle layer, and thus, the sintered material tends to have a smoother surface.

As described hereinbefore, according to the invention, the size of the diffusionally bonded potion or the porosity and strength of a sintered material can be readily controlled by controlling the pressure and temperature and the time without use of any specific type of starting material such as metallic fibers. As a result, sintered materials can be made within a short time as having a porosity of at least 10% or over and having pores open to outside which are formed uniformly throughout the material and also as being provided with required strength and surface processability. Using the fine powder layer on the outer surface, it is possible to make a sintered material which has good mirror finish processabiiity.

The sintered material is adapted for use as a part of a complicatedly shaped mold for plastic moldings which is difficult for de-gassing or which causes molding defects such as sink marks or as a molding material which should have good graining processability and dimensional accuracy. Moreover, the sintered material can be utilized as a metallic material useful on application to air-permeable parts and devices such as sucking and fixing tables for decorative films in-mold decorative moldings (i.e. printing and decoration on plastic articles), air tables, gas bearings and the like.

While the preferred embodiments of the present invention have been illustrated in detail, it should be apparent that modifications and adaptations to those embodiments may occur to one skilled in the art without departing from the scope of the present invention as set forth in the following claims.

What is claimed is:

1. A method for making a sintered material which comprises setting a capsule, which contains a starting powder in a hermetically sealed condition, in a pressure-resistant container, and subjecting said capsule to a combination of a treatment wherein said capsule is heated according to a predetermined temperature pattern and a treatment wherein said capsule is subjected to hot isostatic pressing by introducing a pressurized gas into said pressure-resistant container, characterized in that the pressure in said pressure-resistant container is arrived at a maximum level substantially in coincidence with the commencement of a sintering temperature-applying period in the temperature pattern, and the pressure is gradually decreased from the maximum level during the sintering temperature-applying period.

2. A method according to claim 1, characterized in that said temperature pattern and said maximum pressure level are so set that the resulting sintered material has a porosity of 10% or over.

3. A method according to claim 1, characterized in that a starting powder which is packed at an upper and/or bottom portion of said capsule has an average particle size smaller than a starting material packed in other portions.

4. A method for making a sintered material which comprises setting a capsule, which contains a starting powder in a hermetically sealed condition, in a pressure-resistant container, and subjecting said capsule to a combination of a treatment wherein said capsule is heated according to a predetermined temperature pattern and a treatment wherein said capsule is subjected to hot isostatic pressing by introducing a pressurized gas into said pressure-resistant container, characterized in that the pressure in said pressure-resistant container is gradually increased during a sintering temperature-applying period in the temperature pattern, and the pressure is arrived at a maximum pressure level substantially in coincidence with completion of said sintering temperature-applying period.

5. A method according to claim 4, wherein said temperature pattern and said maximum pressure level are so set that the resulting sintered material has a porosity of 10% or over.

6. A method according to claim 4, characterized in that a starting powder which is packed at an upper and/or bottom portion of said capsule has an average particle size smaller than a starting material packed in other portions.

7. A method for making a wintered material which comprises setting a capsule, which contains a starting powder in a hermetically sealed condition, in a pressure-resistant container, and subjecting said capsule to a combination of a treatment wherein said capsule is heated according to a predetermined temperature pattern and a treatment wherein said capsule is subjected to hot isostatic pressing by introducing a pressurized gas into said pressure-resistant container, characterized in that said pressurized gas is introduced into said pressure-resistant container in such a way that said pressure in said pressure-resistant container is arrived at a maximum pressure level during a sintering temperature-applying period but delayed by a given time after commencement of said sintering temperature-applying period in said temperature pattern.

8. A method according to claim 7, wherein said temperature pattern and said maximum pressure level are so set that the resulting sintered material has a porosity of 10% or over.

9. A method according to claim 7, characterized in that a starting powder which is packed at an upper and/or bottom portion of said capsule has an average particle size smaller than a starting material packed in other portions.

10. A method for making a sintered material which comprises setting a capsule, which contains a starting powder in a hermetically sealed condition, in a pressure-resistant container, and subjecting said capsule to a combination of a treatment wherein said capsule is heated according to a predetermined temperature pattern and a treatment wherein said capsule is subjected to hot isostatic pressing by introducing a pressurized gas into said pressure-resistant container, characterized in that said pressurized gas is introduced into said pressure-resistant container in such a way that said pressure in said pressure-resistant container is arrived at a maximum pressure level prior to commencement of a sintering temperature-applying period in said temperature pattern, and is subsequently lowered to a given sintering pressure before the commencement of said sintering temperature-applying period.

11. A method according to claim 10, wherein said temperature pattern, said maximum pressure level and said sintering pressure are so set that the resulting sintered material has a porosity of 10% or over.

12. A method according to claim 10, characterized in that a starting powder which is packed at an upper and/or bottom portion of said capsule has an average particle size smaller than a starting material packed in other portions.

13. A method for making a sintered material which comprises setting a capsule, which contains a starting powder in a hermetically sealed condition, in a pressure-resistant container, and subjecting said capsule to a combination of a treatment wherein said capsule is heated according to a predetermined temperature pattern and a treatment wherein said capsule is subjected to hot isostatic pressing by introducing a pressurized gas into said pressure-resistant container, characterized in that said metallic powder in said capsule is heated and maintained at a given soaking temperature so that said metallic powder is uniformly heated to the given soaking temperature prior to the introduction of said pressurized gas in said pressure-resistant container, and the pressure in said pressure-resistant container is arrived at a sintering pressure whereby said capsule is subjected to hot isostatic pressing at a given sintering temperature.

14. A method according to claim 13, wherein said soaking temperature is set at a temperature substantially equal to said sintering temperature.

15. A method according to claim 13, wherein said soaking temperature is set at a temperature close to said sintering temperature but is higher than said sintering temperature.

16. A method according to claim 13, wherein said soaking temperature is set at a temperature close to said sintering temperature but is lower than said sintering temperature.

17. A method according to claim 13, wherein said sintering pressure, said sintering temperature and a holding time for said sintering temperature are so set that the resulting sintered material has a porosity of 10% or over.

18. A method according to claim 13, characterized in that a starting powder which is packed at an upper and/or bottom portion of said capsule has an average particle size smaller than a starting material packed in other portions.

19. A method according to claim 13, characterized in that a treatment wherein said metallic powder in said capsule is heated and held at the soaking temperature is conducted in a heating furnace different from said pressure-resistant container, and said capsule is transferred from said heating furnace to said pressure-resistant container wherein said capsule is subjected to the hot isotropic pressing in said pressure-resistant container.

* * * * *